US007439917B2

(12) United States Patent
Harano

(10) Patent No.: US 7,439,917 B2
(45) Date of Patent: Oct. 21, 2008

(54) ANTENNA STRUCTURE AND COMMUNICATION APPARATUS

(75) Inventor: Nobuya Harano, Shizuoka (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/879,316

(22) Filed: Jun. 29, 2004

(65) Prior Publication Data

US 2004/0263394 A1 Dec. 30, 2004

(30) Foreign Application Priority Data

Jun. 30, 2003 (JP) ..... 2003-188857

(51) Int. Cl.
*H01Q 1/24* (2006.01)

(52) U.S. Cl. ..... 343/702

(58) Field of Classification Search ..... 343/702, 343/833, 700 MS, 906
See application file for complete search history.

(56) References Cited

U.S. PATENT DOCUMENTS

| | | | | |
|---|---|---|---|---|
| 4,631,546 | A * | 12/1986 | Dumas et al. | 343/833 |
| 5,365,246 | A * | 11/1994 | Rasinger et al. | 343/702 |
| 5,767,807 | A * | 6/1998 | Pritchett | 342/374 |
| 6,008,761 | A | 12/1999 | Harano | |
| 6,184,833 | B1 | 2/2001 | Tran | |
| 6,239,765 | B1 * | 5/2001 | Johnson et al. | 343/795 |
| 6,417,816 | B2 | 7/2002 | Sadler et al. | |
| 6,512,491 | B2 | 1/2003 | Kanayama et al. | |
| 6,515,633 | B2 * | 2/2003 | Ippolito | 343/797 |
| 6,903,695 | B2 * | 6/2005 | Sjoblom et al. | 343/702 |
| 6,909,401 | B2 * | 6/2005 | Rutfors et al. | 343/702 |
| 2001/0011964 | A1 | 8/2001 | Sadler et al. | |
| 2001/0050647 | A1 | 12/2001 | Kanayama et al. | |

FOREIGN PATENT DOCUMENTS

| | | |
|---|---|---|
| DE | 200 09 412 | 10/2000 |

(Continued)

OTHER PUBLICATIONS

European Search Report dated Oct. 25, 2004.

(Continued)

*Primary Examiner*—Michael C Wimer
(74) *Attorney, Agent, or Firm*—Katten Muchin Rosenman LLP

(57) ABSTRACT

Two antenna elements are planar and stored in a housing. An antenna element is arranged with the antenna faces of the antenna elements orthogonal to the plane of the substrate. The shape, interval, etc. of the antenna element depend on an available frequency. The length of an electric field vector generated between the substrate and the antenna element becomes longer as the antenna element is farther from the substrate. The frequency corresponding to the electric field vector changes corresponding to the radio signal frequency, that is, higher or lower. That is, in the above-mentioned antenna structure, the band of the frequency response is broader. Therefore, in the above-mentioned antenna structure, the frequency response band can be increase and space can be saved in storing an antenna in a housing using a simple structure in which the antenna face of an antenna element is arranged orthogonal to the plane of the substrate.

37 Claims, 13 Drawing Sheets

FOREIGN PATENT DOCUMENTS

| | | |
|---|---|---|
| EP | 1 079 463 | 2/2001 |
| JP | 11-340731 | 12/1999 |
| JP | 2002-9534 | 1/2002 |
| JP | 2002-111348 | 4/2002 |
| JP | 2002-544681 | 12/2002 |
| WO | WO 02/073737 | 9/2002 |

OTHER PUBLICATIONS

Japanese Office Action dated Sep. 6, 2005 for corresponding Japanese Application 2004-173906, with partial translation.

Chinese Office Action dated Aug. 31, 2007, for the corresponding Chinese Application 200410050188.7.

* cited by examiner

ANTENNA STRUCTURE AND COMMUNICATION APPARATUS

BACKGROUND OF THE INVENTION

1. Field of the Invention

The present invention relates to an antenna structure and a communication apparatus, and more specifically to an antenna structure and a communication apparatus for enhancement of the spatial efficiency of an antenna.

2. Description of the Related Art

An antenna adaptive to a 2G (second-generation mobile telephone), a 3G (third-generation mobile telephone), etc. has been proposed by a conventional communication apparatus such as a mobile telephone, etc. due to improved functions of the mobile telephone (refer to Patent Document 1: Japanese Patent Laid-Open No. 11-340731).

The 2G refers to a second-generation mobile telephone, and corresponds to a PDC (personal digital cellular) system or a GSM (global system for mobile communication) system, etc. using digital technology. The second-generation mobile telephone uses a frequency band of 800 to 900 MHz.

The 3G refers to a third-generation mobile telephone, and corresponds to a CDMA (code division multiple access) system, etc. A part of the third-generation mobile telephones use a frequency band of about 1.5 GHz.

The above-mentioned Patent Document 1 proposes a non-feed antenna capable of independently adjusting a plurality of frequencies with a small coupling loss between antennas. That is, the non-feed antenna is a built-in antenna for a plurality of frequencies, and saves space.

In detail, the above-mentioned Patent Document 1 proposes the following configuration. That is, a wireless device has the built-in antenna and a feed antenna arranged outside the wireless device. The outside feed antenna transmits and receives radio waves (electric waves). The built-in antenna, namely the non-feed antenna includes two antennas, that is, a first antenna and a second antenna, and a feeder for interconnection between them. Each of the feed antenna of the wireless device and the first antenna of the non-feed antenna is configured by a loop antenna. Each antenna is located close to each other firmly in a capacitive coupling status. Therefore, the antenna of the wireless device and the first antenna communicate radio wave with each other by the electromagnetic induction through the capacitive coupling (refer to Patent Document 1, paragraph [0044]).

Another prior art is formed by a substrate, a first antenna element provided on one of the right and reverse sides of a sheet or a sheet member, and a second antenna element provided on the other side (refer to Japanese Patent 2: Application Laid-open No.2002-111348). The Patent Document 2 proposes a small antenna capable of easily presenting a frequency response of a broad band.

If the above-mentioned mobile telephones of the respective, generations are incorporated as a complex structure, a plurality of antennas is required. In this case, a small wireless device of a mobile telephone, etc. has the difficulty in incorporating two or more antennas into the wireless device, thereby causing a bottleneck in the development.

That is, a communication apparatus to which antennas are applied has become smaller and thinner. Therefore, in the above-mentioned communication apparatus, an antenna or a communication apparatus is to be downsized to enhance the practicability and operation efficiency.

The present invention aims at providing an antenna structure and a communication apparatus with the spatial efficiency and the utilization improved.

SUMMARY OF THE INVENTION

The antenna structure according to the present invention includes an antenna element having an antenna face and a planar substrate. The antenna face of the antenna element is located orthogonal to the plane of the substrate. When a signal voltage is applied to the antenna element, the antenna element is excited by the resonant frequency.

In the present invention, the conductive pattern of a substrate also functions as an antenna. Therefore, an additional antenna is not required, thereby largely contributing to saving space.

In the antenna structure according to the present invention, a plurality of antenna elements are arranged with the antenna face of each antenna element facing each other at a predetermined interval. In this case, when a signal voltage is applied to one antenna element, the resultant induced current induces a current to the other antenna element (non-feed element). Therefore, both antenna elements are excited at a natural resonant frequency.

In the antenna structure according to the present invention, as shown in FIG. 22, an antenna element 100 is arranged such that the an antenna face 100A of the element 100 as orthogonal to the plane of a substrate 200. In this case, if frequencies of the signals are changed, the electric field induced between the antenna element 100 and the substrate 200 are different. Therefore, lengths of the electric field vectors (arrows E1 to E3 shown in FIG. 22) of the antenna element 100 to the substrate 200 are not uniform.

In the antenna structure shown in FIG. 22, the antenna faces 100A of a pair of antenna elements 100 face each other at a predetermined interval.

As shown in FIG. 23, an antenna element 101 can be arranged parallel to the substrate 200. In this configuration of the antenna, the direction of the current-flow to the substrate 200 is parallel to that of the current-flow to the antenna element 101, and the lengths of the electric field vectors (arrows E1 to E3 shown in FIG. 23) are uniform between them. That is, in the antenna structure shown in FIG. 23, the lengths of the electric field vectors between the antenna element 101 and the substrate 200 are uniform, and the frequencies corresponding to the electric field vectors (arrows E1 to E3 shown in FIG. 22) are also uniform between the substrate 200 and the antenna element 101.

On the other hand, in the antenna structure according to the present invention (for example, the structure shown in FIG. 22), the lengths of the electric field vectors E1 to E3 between the substrate 200 and the antenna element 100 become longer as the antenna element 100 is arranged farther from the substrate 200.

The frequency corresponding to the electric field vector (arrow E1 shown in FIG. 22) is higher than that corresponding to the electric field vector (arrow E2 or E3 shown in FIG. 22). That is, the frequency corresponding to the electric field vector changes corresponding to the frequency of a radio signal, that is, becomes higher or lower. Therefore, in the antenna structure according to the present invention, the band of the frequency response (antenna characteristic) is broader than in the antenna structure shown in FIG. 23.

According to the present invention, broad band communications can be realized in a simple structure in which the antenna face of an antenna element is arranged orthogonal to the plane of the substrate. For example, according to the present invention, a single antenna can be applied to the frequency band of 800 to 900 MHz of the second-generation mobile telephone and the frequency band of 1.5 GHz in the third-generation mobile telephone in the communications.

Also in the antenna structure according to the present invention, the antenna element is arranged orthogonal to the substrate, he effective space for the antenna element in the housing of a communication apparatus can be large enough. That is, in the antenna structure according to the present invention, the spatial efficiency can be enhanced. Therefore, an efficient antenna structure can be realized with saved antenna space.

As a result, since the antenna face of an antenna element is arranged orthogonal to the plane of the substrate in the antenna structure according to the present invention, the space can be saved in storing an antenna in the housing with the band of the antenna response extended.

The communication apparatus according to the present invention includes an antenna element having an antenna face and a planar substrate. The antenna face of the antenna element is arranged orthogonal to the plane of the substrate. Since the spatial efficiency can be enhanced in the communication apparatus according to the present invention, as in the antenna structure according to the present invention, an efficient communication apparatus can be realized with saved antenna space.

BRIEF DESCRIPTION OF THE DRAWINGS

This above-mentioned and other objects, features and advantages of this invention will become more apparent by reference to the following detailed description of the invention taken in conjunction with the accompanying drawings, wherein.

DESCRIPTION OF THE PREFERRED EMBODIMENTS

Figure 1A:
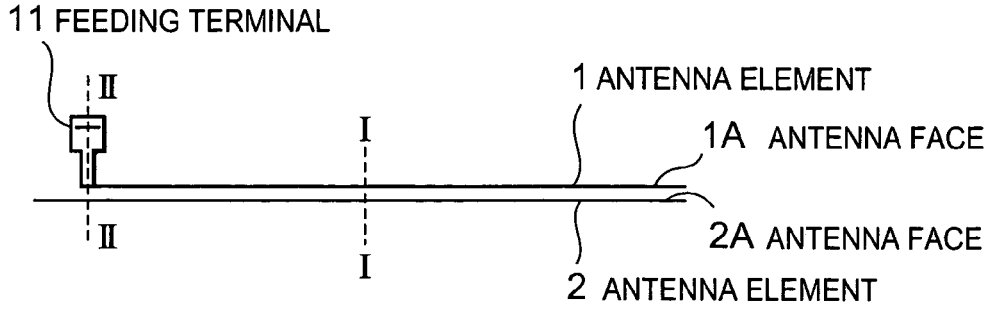
FIG. 1A is a side view along the length of the antenna structure according to the first embodiment of the present invention.

The embodiments of the antenna structure and communication apparatus according to the present invention are explained in detail by referring to the attached drawings. FIGS. 1 to 22 show the embodiments of the antenna structure and communication apparatus according to the present invention. The communication apparatus according to the present embodiment is a small wireless device such as a mobile telephone, etc.

Basic Configuration

An antenna according to the present embodiment is a built-in antenna in a small wireless device. The antenna is configured by a planar substrate having a plurality of antenna elements and conductive patterns (circuit patterns). A signal voltage is applied to one of the plurality of antenna elements (refer to FIGS. 3 and 4). The surface of an antenna element functions as an antenna face. There can be only one antenna element according to the present embodiment.

The antenna element is planar, and arranged at the end portion along the length of the housing of a wireless device. The antenna element is arranged such that the face as facing the wall surface of the end portion. The antenna element is arranged such that the face as orthogonal to the plane of the substrate. The antenna faces of a plurality of antenna elements are parallel to one another, and arranged close to one another. At this time, the antenna faces are arranged such that the overlapping areas can be larger.

A plurality of antenna elements can be fixed with resin. In this case, the shape of an antenna element is stable, and therefore the interval between antenna elements can be constant. According to another embodiment, the shape of each antenna element can be formed along the internal wall of the housing, and the antenna element can be arranged close to the internal wall of the housing.

The feeding terminal which is feeding means can be provided by forming a part of the flat plate of an antenna element as a spring type. The feeding terminal can also be a spring connector. In this case, the antenna element is connected to a connection part of a wireless circuit through the spring connector.

The feeding terminal can also be a contact connector mounted on the substrate. The contact connector connects the wireless circuit to the antenna element. Therefore, a connection unit is provided for connection in the antenna element side.

Furthermore, one or both of the two antenna elements can be meandering or making hairpin turns. The antenna can be attached to the housing using double-faced tape.

Additionally, a buffering cushion can be inserted between the housing and the antenna element. In this case, when an antenna element is stored in a housing the antenna element is pressed by the cushion. With this configuration, the antenna element can be firmly fixed stable in the housing.

Described below in more detail are the first through sixth embodiments.

Configuration of First Embodiment

FIGS. 1A to 11 show the first embodiment of the present invention. FIGS. 1A to 4 show examples of the configurations of the antenna in the first embodiment. FIGS. 5 to 11 show examples of a variation or an application according to the first embodiment.

Figure 1B:
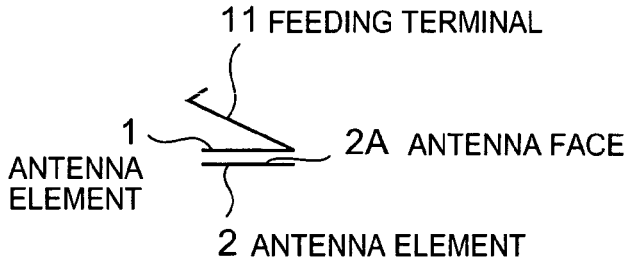
FIG. 1B is a side view in the direction orthogonal to the length of the antenna structure shown in FIG. 1A.

As shown in FIGS. 1A and 1B, the antenna element according to the first embodiment has two antenna elements, that is, a first antenna element 1 and a second antenna element 2. In the present embodiment, a signal voltage is supplied only to the antenna element 1 of the two antenna elements 1 and 2.

A feeding terminal 11 for supply of signal voltage as feeding means is configured in one antenna element 1. The feeding terminal 11 is formed as a spring-shaped using a part of a metal plate of the planar antenna element 1. The tip of the feeding terminal 11 is bent with a V-shaped sectional view.

The feeding terminal 11 is connected to a connection unit of a wireless circuit (not shown in the attached drawings) of a substrate 20. Therefore, a signal voltage (radio transmission signal) is supplied from a wireless circuit to the feeding terminal 11, or a signal of the frequency of the radio wave generated by the electric field coupling between the substrate 20 and the antenna element 1 is supplied to the wireless circuit.

According to the present embodiment, since the feeding terminal 11 is spring-shaped and bent in a V-shape, the feeding terminal 11 urges to the connection unit of the substrate 20. The feeding terminal 11 can be correctly connected to the connection unit of the substrate 20.

Figure 3:
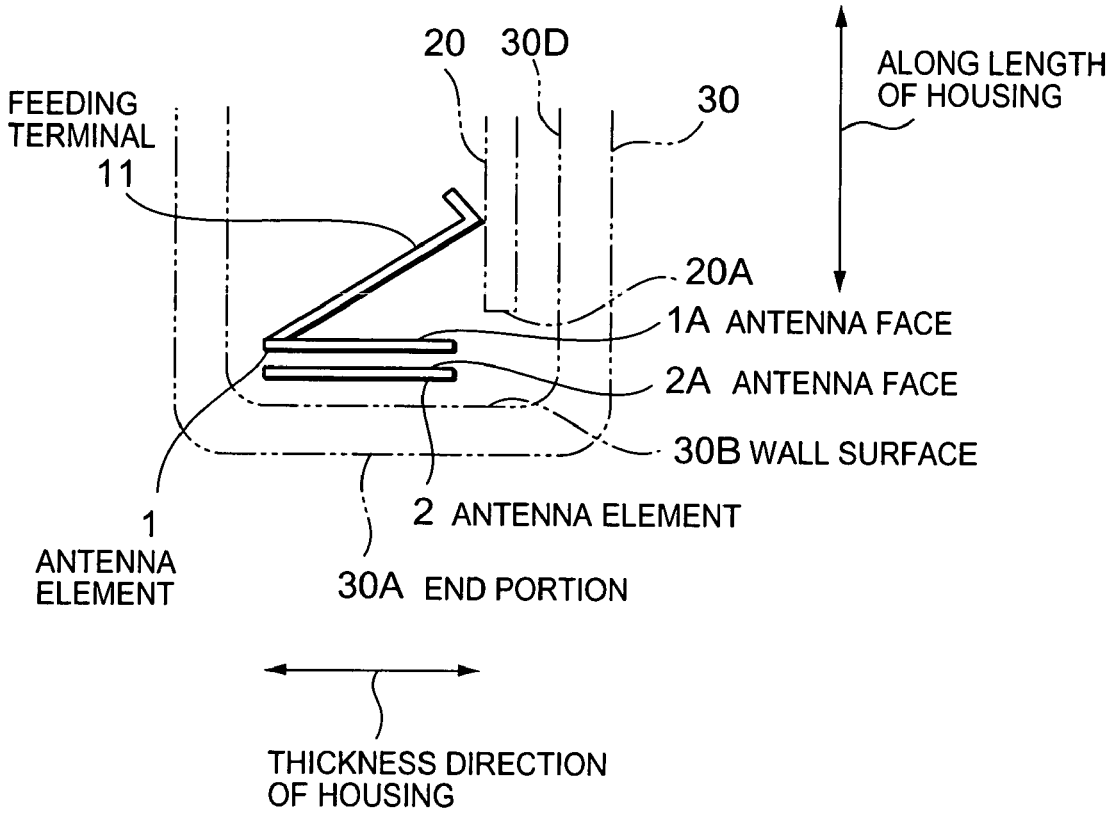
FIG. 3 is a sectional view along the line II-II shown in FIG. 1A.
Figure 4:
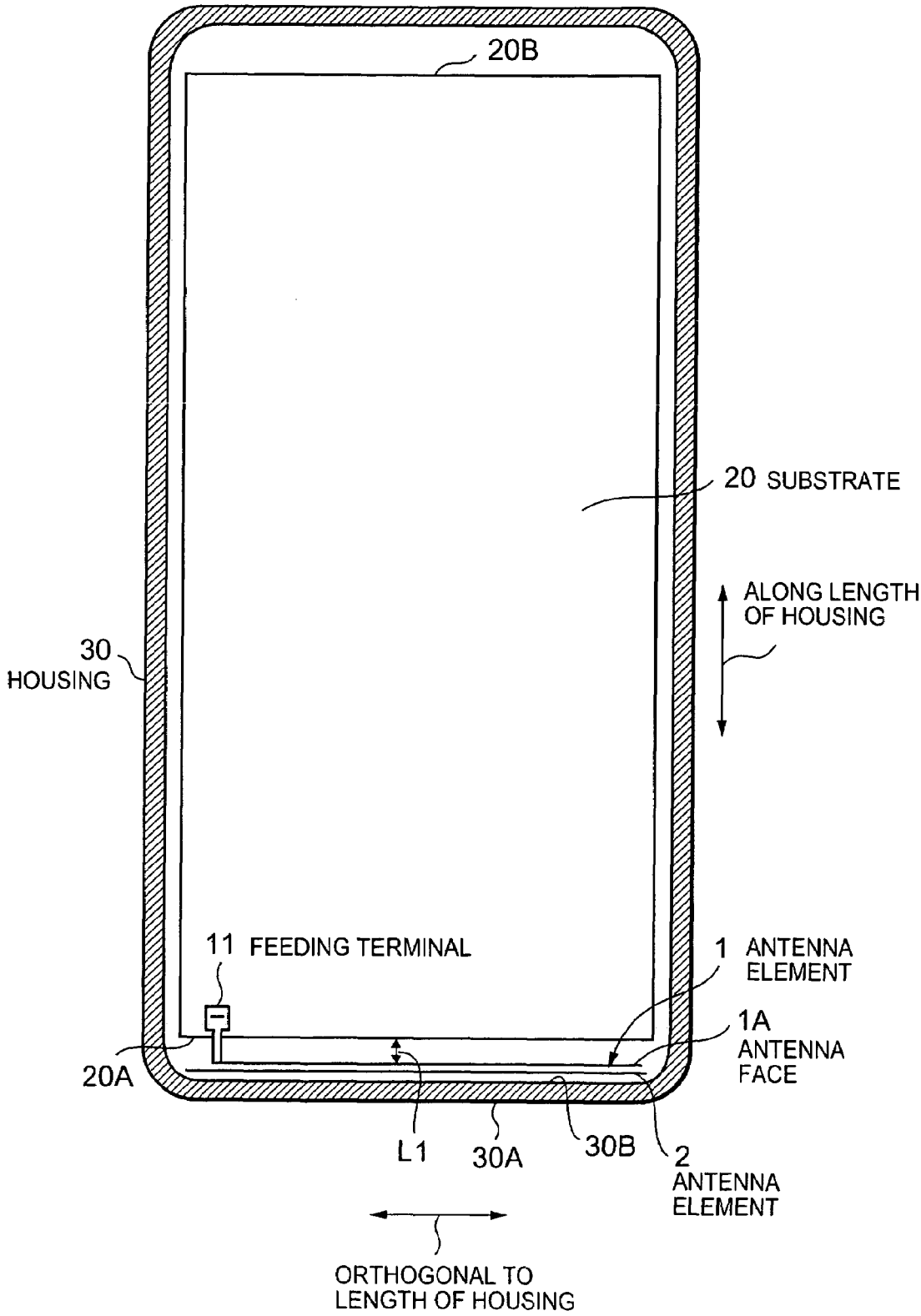
FIG. 4 shows the concept of the antenna shown in FIG. 1 arranged and stored in the wireless device.

The antenna elements 1 and 2 are planar (plate-shaped) (refer to FIGS. 1A and 4). As shown in FIG. 3, the length D1 (refer to FIG. 1C) in the direction orthogonal to the length (in the view along the shortened) of the antenna elements 1 and 2 is approximately half of the length in the thickness direction of a housing 30.

As shown in FIGS. 3 and 4, the antenna elements 1 and 2 are built in an end portion 30A along the length of the housing 30 of the communication apparatus. The antenna elements are incorporated such that, for example, the antenna faces 1A and 2A of the antenna elements 1 and 2 can be arranged parallel to a planar wall surface 30B of the end portion 30A and an end portion 20A along the length of the substrate 20. That is, the antenna element 2 is arranged such that the antenna face 2A of the antenna element 2 faces the wall surface 30B. Furthermore, the antenna element 1 is arranged at a predetermined interval L1 from the end portion 20A of the substrate 20. The predetermined interval L1 can be, for example, 1 to 10 mm based on the result of experiments.

The shape of the antenna elements 1 and 2 depends on a desired and available frequency, for example, 800 to 900 MHz or 1.5 GHz, etc. The antenna elements 1 and 2 are arranged to guarantee the capacitive coupling between the antenna elements 1 and 2 by a larger lapping areas of the surfaces of the antenna faces 1A and 2A.

Figure 2:
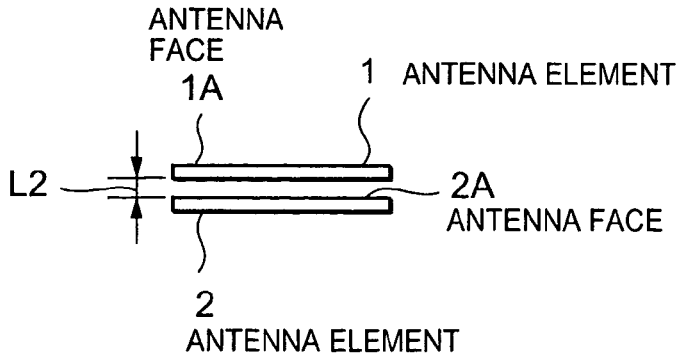
FIG. 2 is a sectional view along the line I-I shown in FIG. 1A.

As shown in FIG. 2, the two antenna elements 1 and 2 are arranged parallel and at predetermined interval L2. The predetermined interval L2 can be, for example, 1 to 5 mm based on the result of experiments.

The antenna elements 1 and 2 are located in the housing 30 by support means (not shown in the attached drawings), for example, a support block. According to the present embodiment, the interval between the antenna element and the end portion along the length of the substrate, the interval between antenna elements, the shape of an antenna element, etc. depend on the available frequency.

In the present embodiment, the substrate 20 in which a plurality of electronic parts are mounted is used also as a component of an antenna. The planar (plate-shaped) substrate 20 has a layer structure including a conductive pattern such as a ground layer, a power supply layer, etc., and the conductive pattern functions as an antenna.

The substrate 20 is configured as shown in FIG. 4 such that the planar shape of the substrate 20 corresponds to the planar shape of the housing 30. As shown in FIG. 3, the arrangement is made such that the plane of the substrate 20 can face, and can be close to, a wall surface 30D in the direction orthogonal to the length of the housing 30. The substrate 20 is located in the housing 30 through fixing means not shown in the attached drawings.

Operation of First Embodiment

When a signal voltage is supplied from a wireless circuit to the first antenna element 1, the induced current induces a current also to the second antenna element (non-feed element) 2. Therefore, the antenna elements 1 and 2 are excited by the natural resonant frequency.

Figure 22:
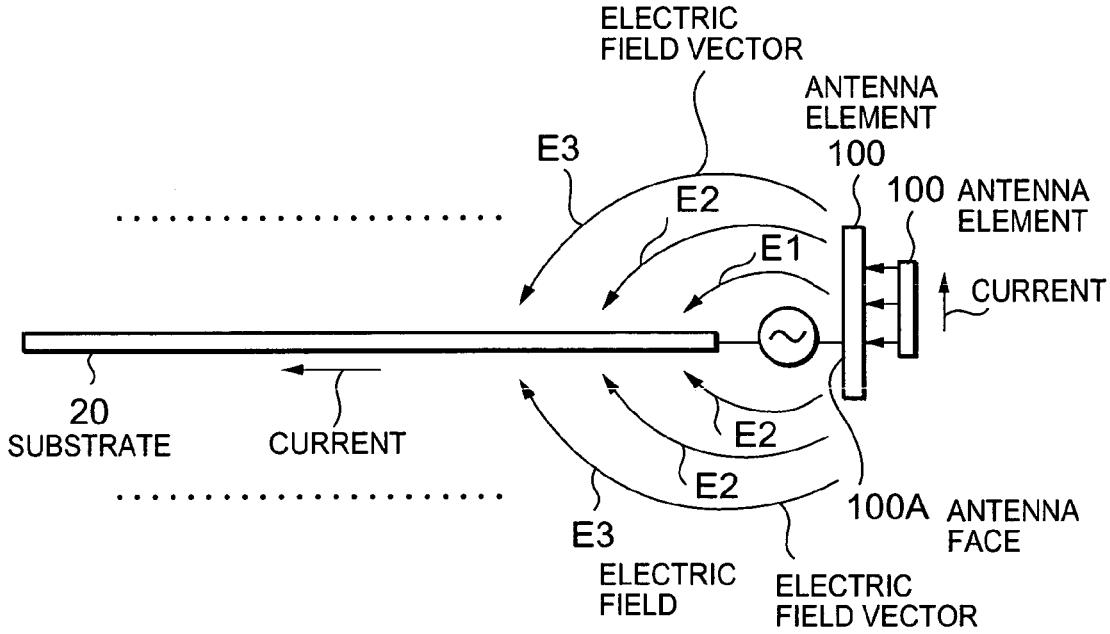
FIG. 22 shows the concept of the antenna response according to the present invention.

On the other hand, as shown in FIG. 22, according to the present embodiment as described above, since the antenna faces 1A and 2A of the antenna elements 1 and 2 is located 90 degrees from the plane of the substrate 20, the orientations of the current and the electric field the antenna and the substrate. Therefore, the lengths of the electric field vectors (arrows E1 to E3 shown in FIG. 22) of the antenna element for the substrate are not uniform.

In the antenna structure shown in FIG. 22, the lengths of the electric field vectors E1 to E3 between the substrate 200 and the antenna element 100 become longer as the antenna element 100 is arranged farther from the substrate 200.

Figure 23:
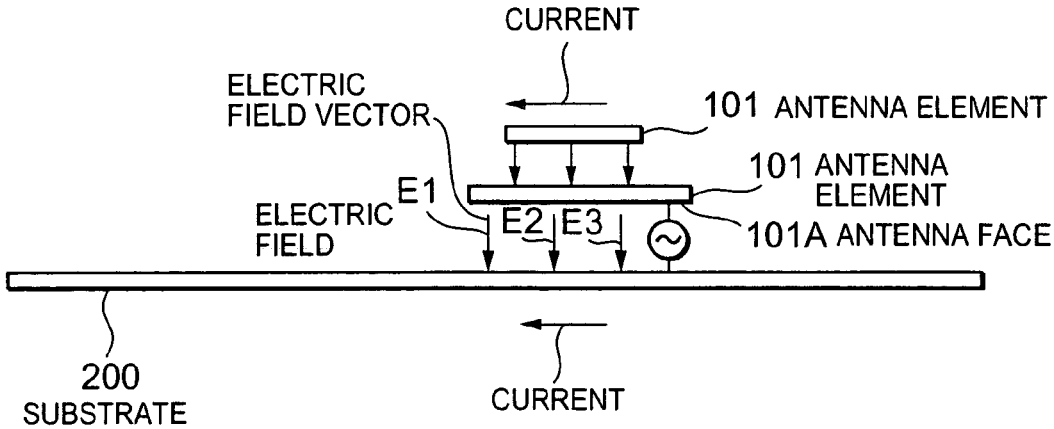
FIG. 23 shows the concept of the antenna response when an antenna element is arranged parallel to the substrate.

The frequency corresponding to the electric field vector (arrow E1 shown in FIG. 22) is higher than the frequency corresponding to the electric field vector (arrow E2 or E3 shown in FIG. 22). That is, in the above-mentioned antenna structure, as compared with the antenna structure shown in FIG. 23, the band of the frequency response (antenna characteristic) is broader. Therefore, in the present embodiment, broad band communications can be realized in a simple structure in which the antenna face of an antenna element is arranged orthogonal to the plane of the substrate.

A common mobile communication apparatus is portrait style so that a user can easily handle it. Therefore, in the antenna structure shown in FIG. 4, the maximum length of the electric field vector of the antenna element 1 for the substrate 20 is almost equal to the length around the other end portion 20B along the length of the substrate 20. That is, when the antenna elements 1 and 2 are arranged at the end portion 20A along the length of the substrate 20, the band of the frequency response is broader than in the case in which the antenna elements 1 and 2 are arranged at the end portion in the direction orthogonal to the length of the substrate 20.

Effect of the First Embodiment

According to the present embodiment, since two antenna elements 1 and 2 are arranged parallel and close to each other, the capacitive coupling between the two antenna elements 1 and 2 can be firm. Therefore, according to the present embodiment, the current of the first antenna element 1 provided with a signal voltage can be efficiently transmitted to the second antenna element 2 which is a non-feed element as a induced current. Also according to the present embodiment, two antenna elements 1 and 2 are arranged parallel and close to each other, thereby saving space.

According to the present embodiment, the antenna-elements 1 and 2 are arranged at predetermined intervals from the end portion 20A of the substrate 20 at the end portion 30A of the housing 30, and the antenna faces 1A and 2A of the antenna elements 1 and 2 can be set orthogonal to the plane of the substrate 20.

As a result, in the present embodiment, since the antenna elements 1 and 2 are arranged orthogonal to the planes of the substrate 20, the effective space for the antenna element in the housing 30 can be easily reserved. Therefore, according to the present embodiment, the spatial efficiency can be enhanced, and an efficient antenna structure and communication apparatus can be realized although the setting space for an antenna is small.

When the antenna unit 4 is arranged at the end portion 30A of the housing 30, the antenna unit 4 is not in the way, and can save space. When the plane of the substrate 20 is arranged close to the wall surface 30D in the thickness direction of the housing 30, and the antenna unit 4 is arranged at the end portion 30A of the housing 30, the space can also be saved.

Figure 5:
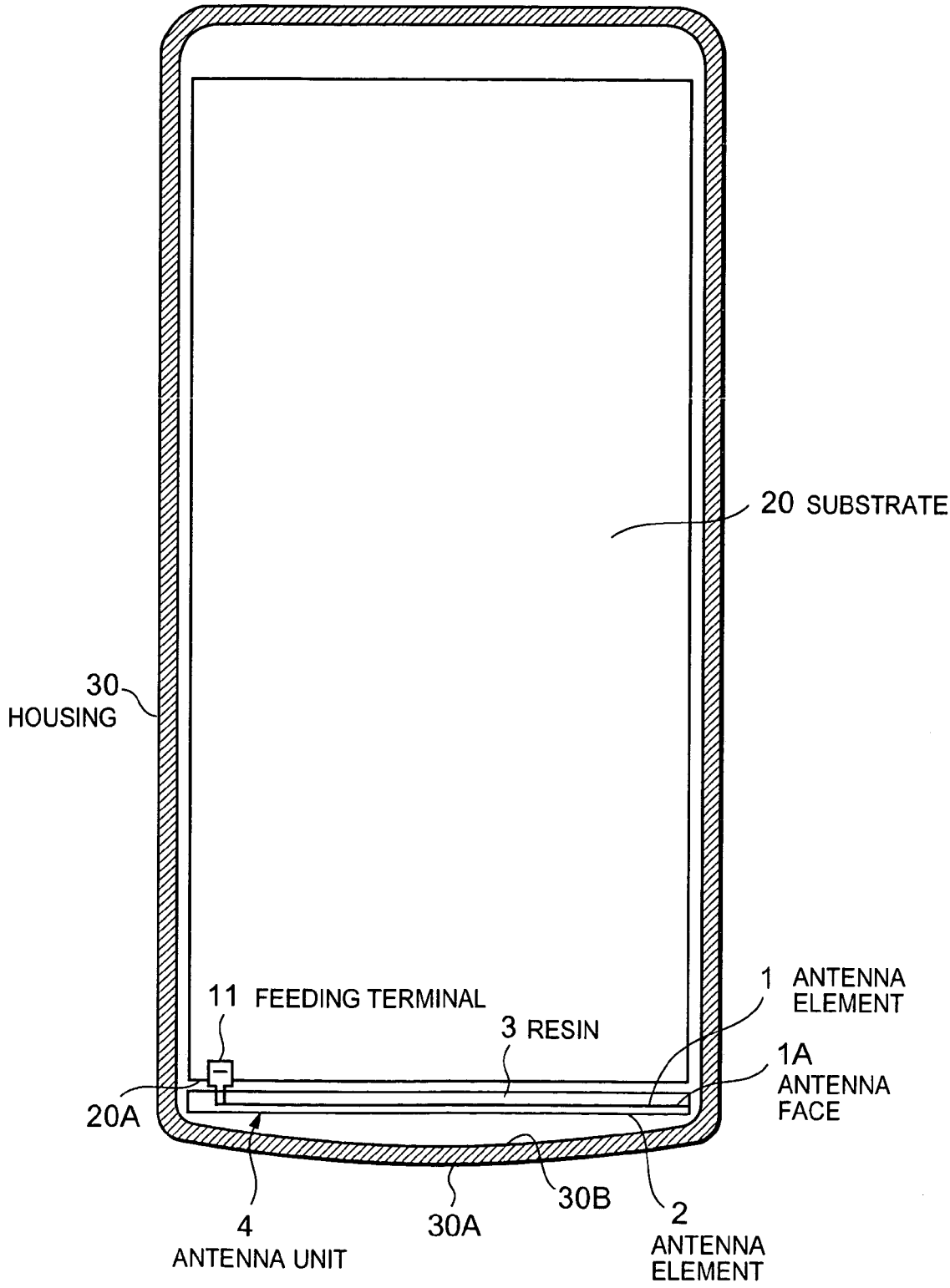
FIG. 5 shows the concept of the antenna in a variation and an application of the antenna structure shown in FIG. 1 arranged and stored in a wireless device.

FIG. 5 shows an example of a variation. As shown in FIGS. 5, 6A, 7, and 8, the two antenna elements 1 and 2 are fixed with resin 3 to hold the antenna elements 1 and 2 parallel to each other. The resin 3 is plastic, epoxy resin, acrylic resin, etc. The antenna elements 1 and 2 fixed with the resin 3 can be formed as an antenna unit 4. Therefore, the antenna elements 1 and 2 are fixed with the resin 3 into the antenna unit 4, and the built-in antenna unit 4 in the housing 30 can be easily mounted.

Figure 6A:
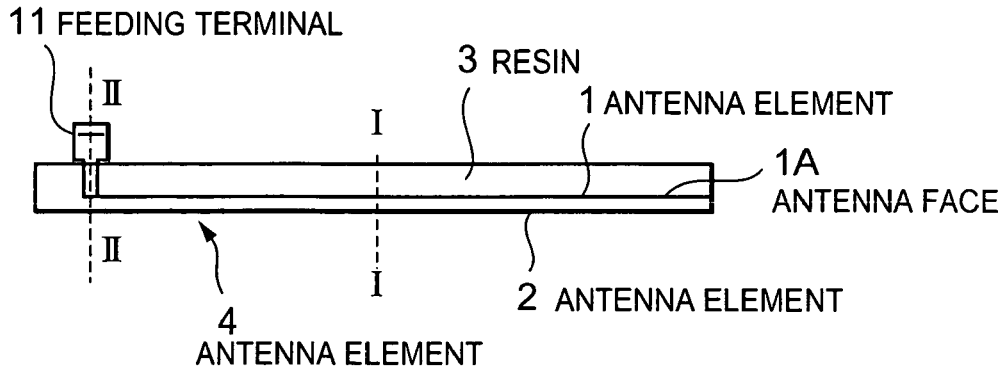
FIG. 6A is a side view along the length of the antenna shown in FIG. 5.
Figure 6B:
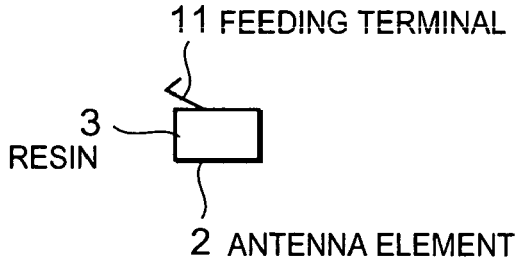
FIG. 6B is a side view in the direction orthogonal to the length of the antenna structure shown in FIG. 6A.
Figure 6C:
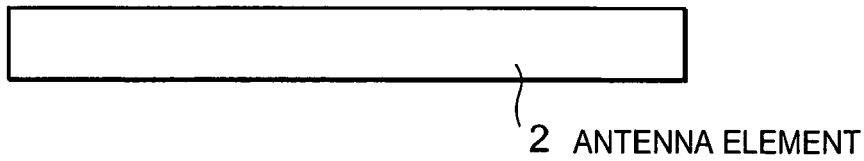
FIG. 6C shows the bottom of the antenna structure shown in FIG. 6A.
Figure 7:
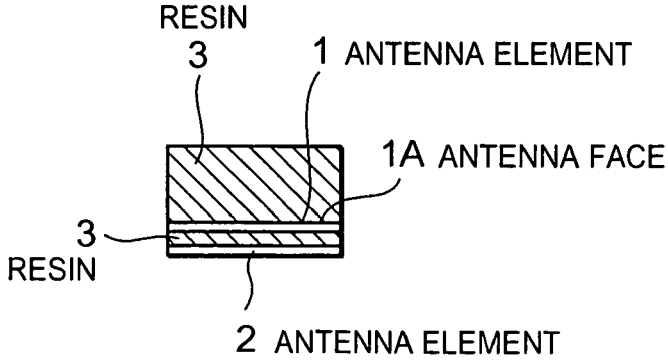
FIG. 7 is a sectional view along the line I-I shown in FIG. 6A.
Figure 8:
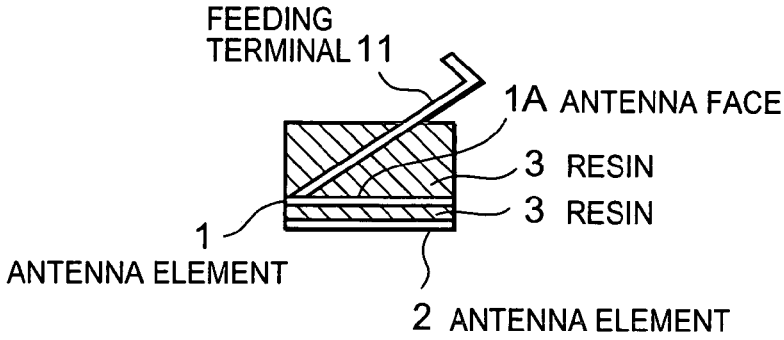
FIG. 8 is a sectional view along the line II-II shown in FIG. 6A.

As shown in FIG. 5, the end portion 30A of the housing 30 is curved as bending outside the housing 30. That is, a small communication apparatus such as a mobile telephone, etc. can have the end portion 30A of the housing 30 in a curved shape. FIG. 6B is a side view in the direction orthogonal to the length of the antenna structure shown in FIG. 6A, and FIG. 6C shows the bottom of the antenna structure according to FIG. 6A.

Figure 9:
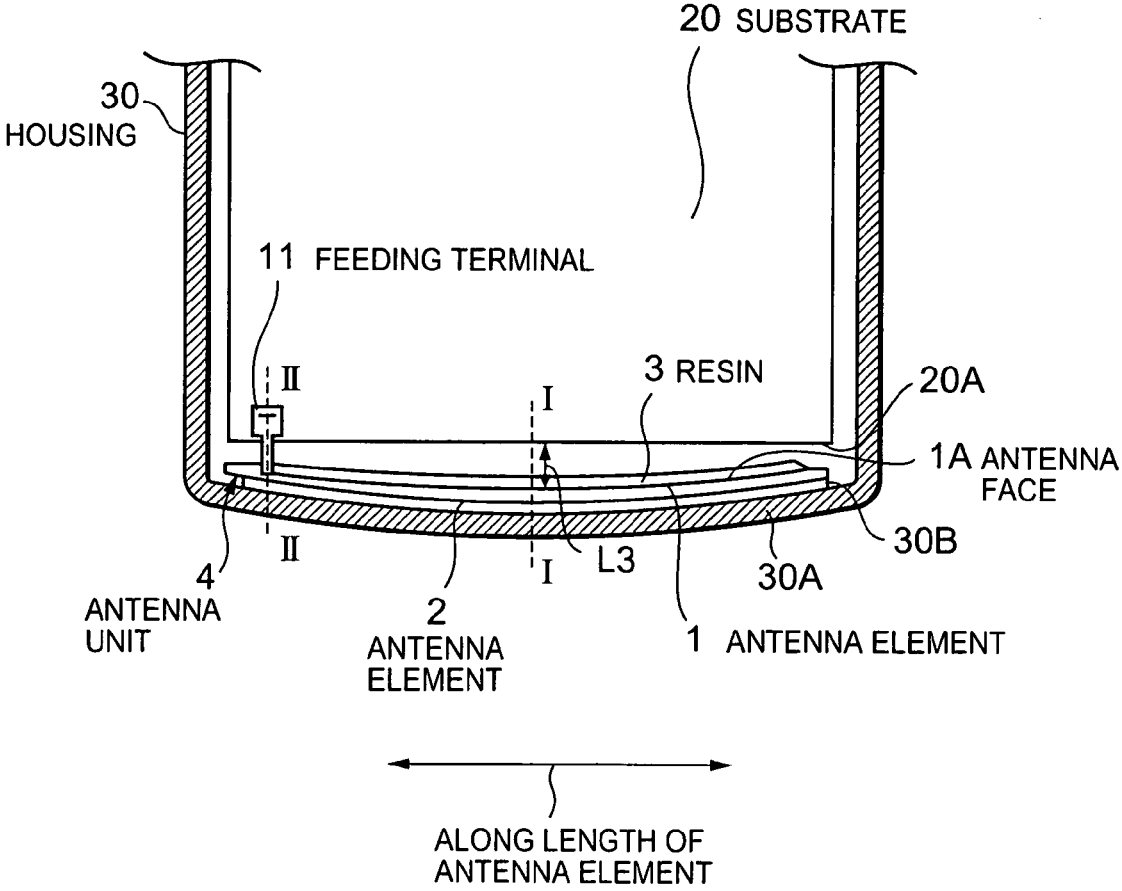
FIG. 9 shows the concept of the antenna in a variation and an application of the antenna structure shown in FIG. 5 arranged and stored in a wireless device.
Figure 10:
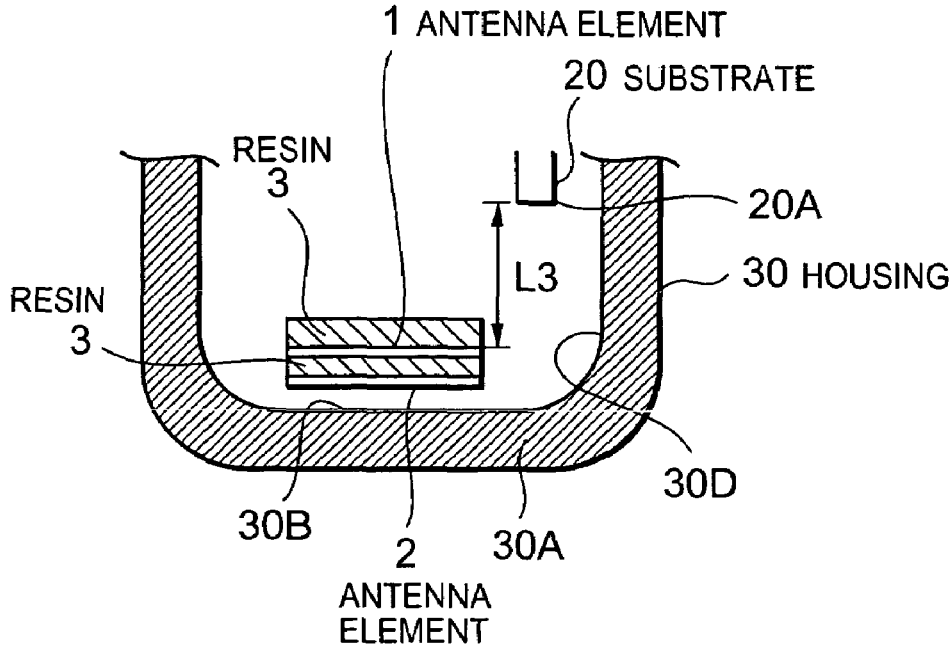
FIG. 10 is a sectional view along the line I-I shown in FIG. 9.
Figure 11:
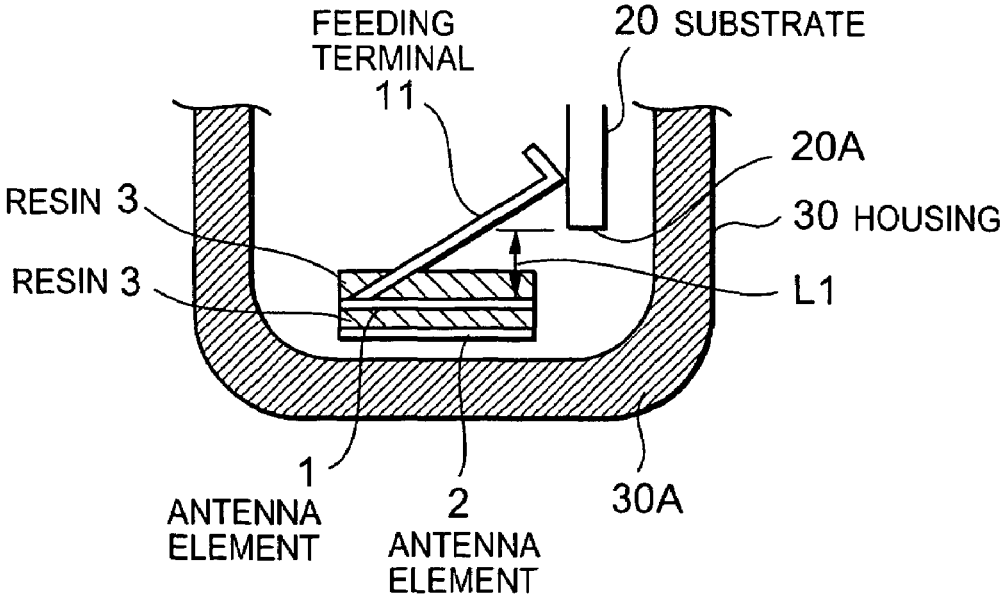
FIG. 11 is a sectional view along the line II-II shown in FIG. 9.

The variation shown in FIG. 9 shows the antenna unit 4, in which the antenna elements 1 and 2 are fixed with the resin 3, in a curved shape along the end portion 30A of the housing 30. The antenna elements 1 and 2 are built in the end portion 30A of the housing 30, and the antenna faces 1A and 2A of the antenna elements 1 and 2 are arranged close to each other along the wall surface 30B of the end portion 30A. When the wall surface 30B of the housing 30 is rough (e.g., unevenness), the antenna elements 1 and 2 can be formed to be follow the rough surface of the wall 30B.

When the antenna face 1A of the antenna element 1 is closer to the end portion 20A of the substrate 20 exceeding a predetermined distance, the radiation impedance (that is, capacitive loss) increases. Therefore, it is well known that the transmission and reception efficiency of the radio wave between the antenna element 1 and the substrate 20 is reduced.

In the variation shown in FIG. 9, relating to the distance between the antenna face 1A of the antenna element 1 and the end portion 20A of the substrate 20, the distance L3 (refer to FIGS. 9 and 10) in the central portion along the length of the antenna elements 1 and 2 is longer than the distance L1 (refer to FIG. 11) in both end portions along the length of the antenna elements 1 and 2.

In the variation shown in FIG. 9, the distance L3 between the antenna face 1A of the antenna element 1 and the end portion 20A of the substrate 20 can be set longer than the predetermined distance. Therefore, higher frequency response can be obtained. That is, according to a variation shown in FIG. 9, the end portion 30A of the housing 30 can be effectively used as antenna space.

Second Embodiment

Figure 12A:
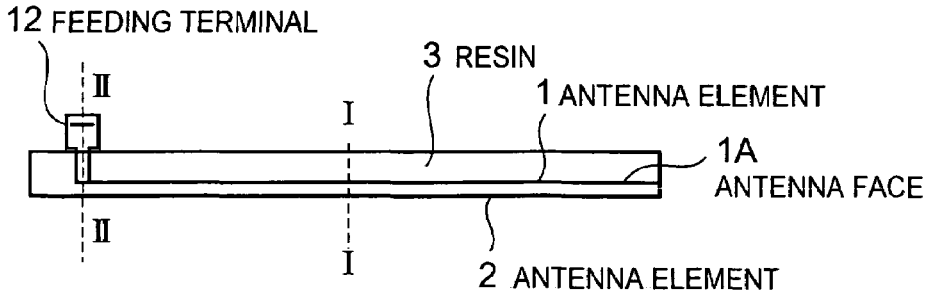
FIG. 12A is a side view along the length of the antenna according to the second embodiment.
Figure 12B:
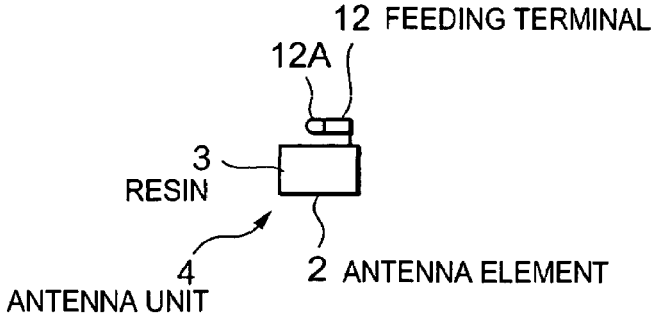
FIG. 12B is a side view in the direction orthogonal to the length of the antenna structure shown in FIG. 12A.
Figure 12C:
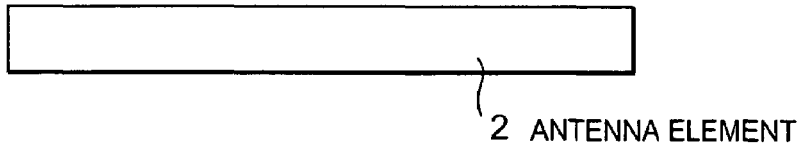
FIG. 12C shows the bottom of the antenna structure shown in FIG. 12A.
Figure 13:
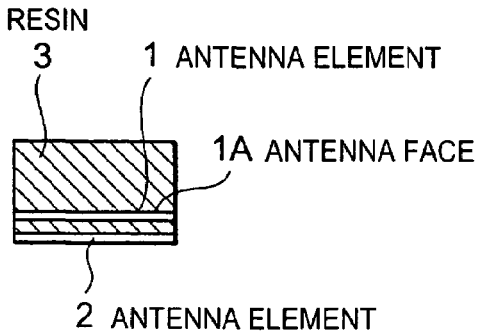
FIG. 13 is a sectional view along the line I-I shown in FIG. 12A.
Figure 14:
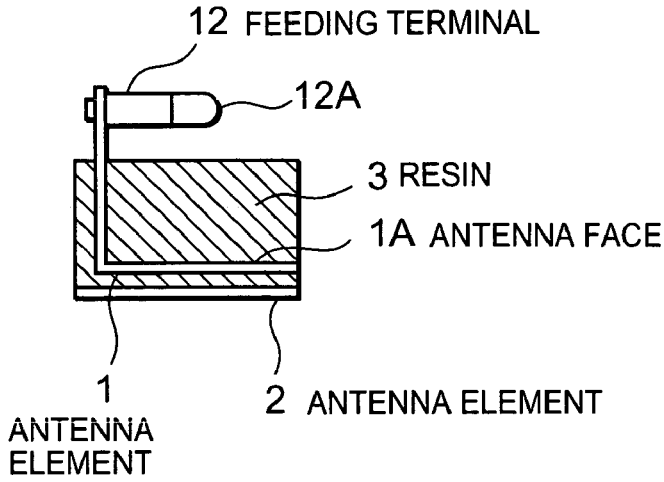
FIG. 14 is a sectional view along the line II-II shown in FIG. 12A.

FIGS. 12 to 14 show the second embodiment according to the present invention. A feeding terminal 12 according to the second embodiment uses a spring connector 12A as a part of the feeding terminal 12. The antenna element 1 is connected to the wireless circuit of the substrate 20 (refer to FIG. 5) through a spring connector 12A. The other configuration and the operation effect are the same as those according to the embodiment shown in FIG. 5, the detailed explanation is omitted here.

Third Embodiment

Figure 15:
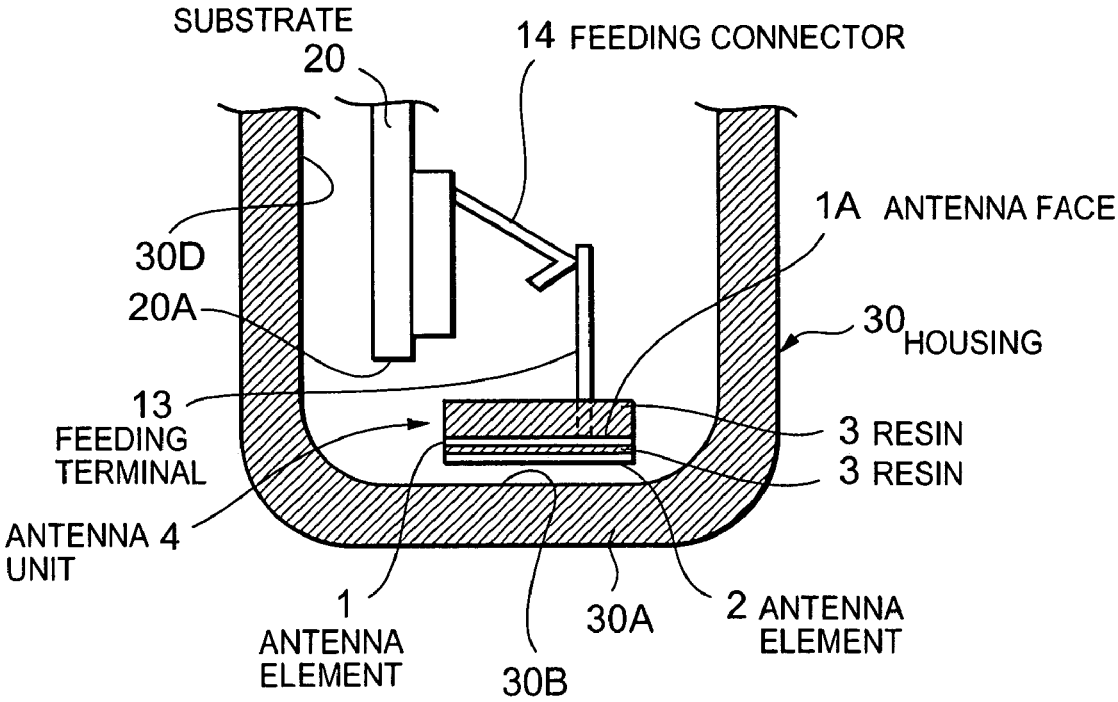
FIG. 15 shows the concept of the antenna according to the third embodiment arranged and stored in the wireless device.

FIG. 15 shows the third embodiment of the present invention. In the third embodiment, a feeding terminal 13 forming part of the feeding means is provided in the antenna element 1. The feeding terminal 13 is planar. The substrate 20 is provided with a planar feeding connector 14. The feeding connector 14 is spring-shaped, and the tip of the feeding connector 14 is bent in V shape.

Since the feeding connector 14 forming part of the connection unit is connected to the feeding terminal 13 according to the third embodiment, a wireless circuit of the substrate 20 is connected through the feeding connector 14. The feeding connector 14 urges to the feeding terminal 13. Other configurations and operation effects are the same as those according to the embodiment shown in FIG. 5. Therefore, the detailed explanation is omitted here.

Fourth Embodiment

Figure 16A:
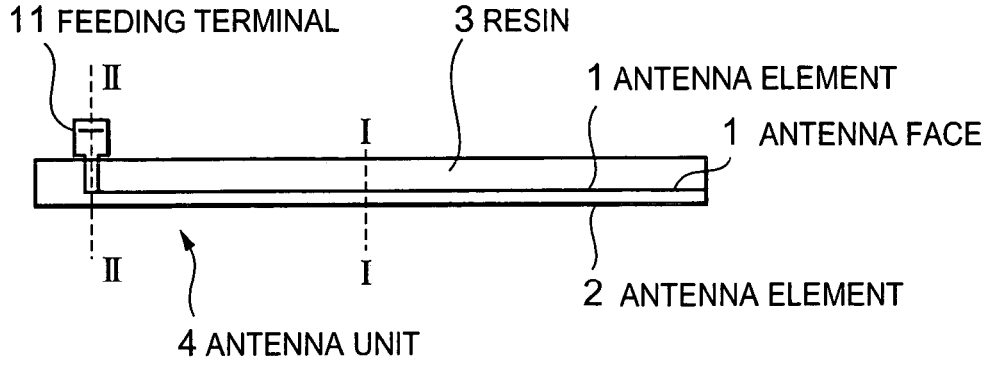
FIG. 16A is a side view along the length of the antenna according to the fourth embodiment.
Figure 16B:
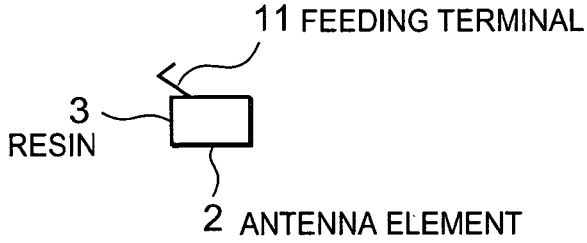
FIG. 16B is a side view in the direction orthogonal to the length of the antenna structure shown in FIG. 16A.
Figure 16C:
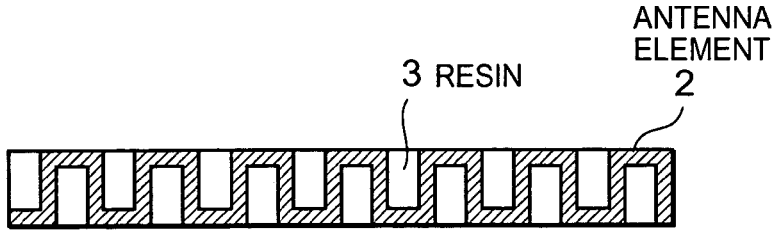
FIG. 16C shows the bottom of the antenna structure shown in FIG. 16A.
Figure 17:
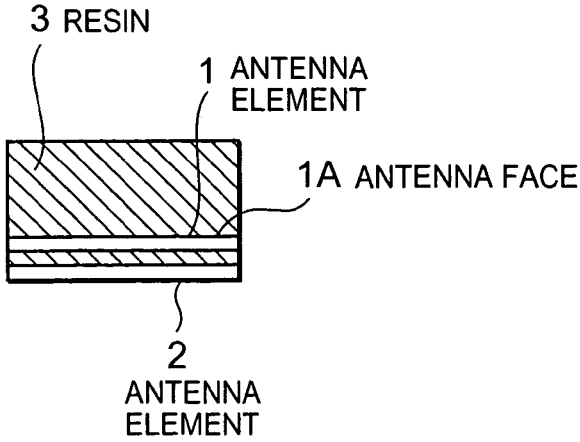
FIG. 17 is a sectional view along the line I-I shown in FIG. 16A.
Figure 18:
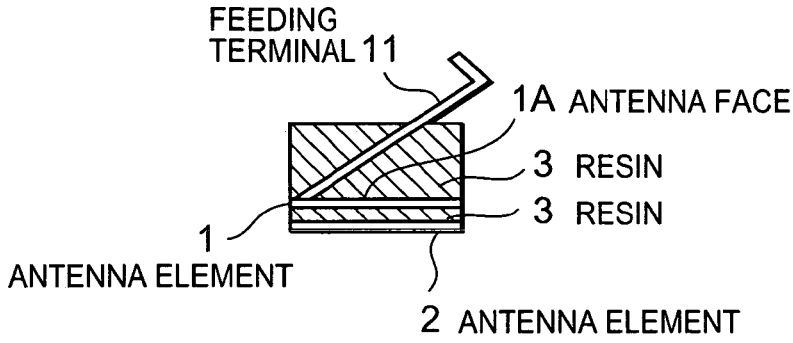
FIG. 18 is a sectional view along the line II-II shown in FIG. 16A.

FIGS. 16A to 16C, 17, and 18 show the fourth embodiment of the present invention. In the fourth embodiment, one or both of the two antenna elements 1 and 2 according to the first embodiment are bent. For example, in the antenna element 2 as shown in FIG. 16C, the plane pattern of the antenna element 2 is meandering.

In the fourth embodiment, the meandering antenna element 2 enables a desired frequency to be set. As shown in FIG. 16C, when the antenna element 2 is bent in meandering pattern, the antenna element 2 can be longer in actual size (longer wavelength) than in the case shown in FIG. 1C, thereby lowering the frequency.

In another variation, the antenna element can be bent in a three-dimensional array. Other configurations and operation effects are the same as those in the embodiment shown in FIG. 5. Therefore, the detailed explanation is omitted here.

Fifth Embodiment

Figure 19:
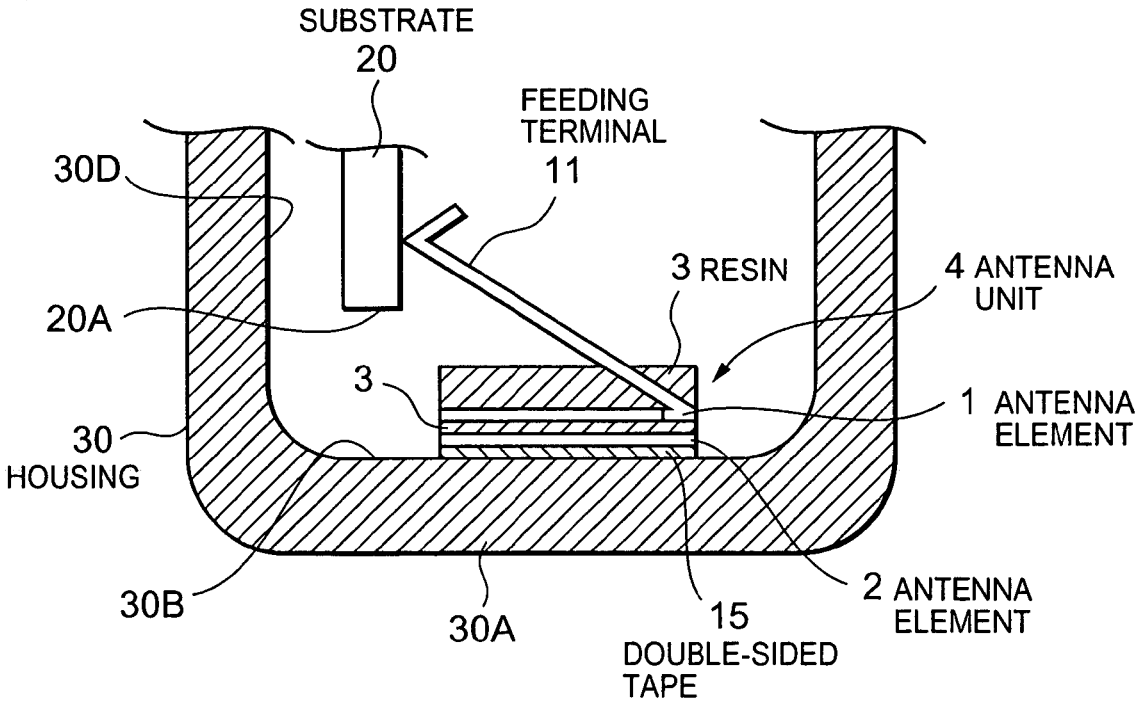
FIG. 19 shows the concept of the antenna according to the fifth embodiment arranged and stored in the wireless device.

FIG. 19 shows the fifth embodiment of the present invention. In the fifth embodiment, the antenna unit 4 including the two antenna elements 1 and 2 fixed with the resin 3 is attached to the wall surface 30B of the end portion 30A of the housing 30 by a double-sided tape 15 as attachment means.

According to the fifth embodiment, the antenna unit 4 is attached to the end portion 30A of the housing 30 using the double-sided tape 15. Therefore, the antenna unit 4 can be easily attached. Other configurations and operation effects are the same as those of the embodiment shown in FIG. 5. Therefore, the detailed explanation is omitted here.

Sixth Embodiment

Figure 20:
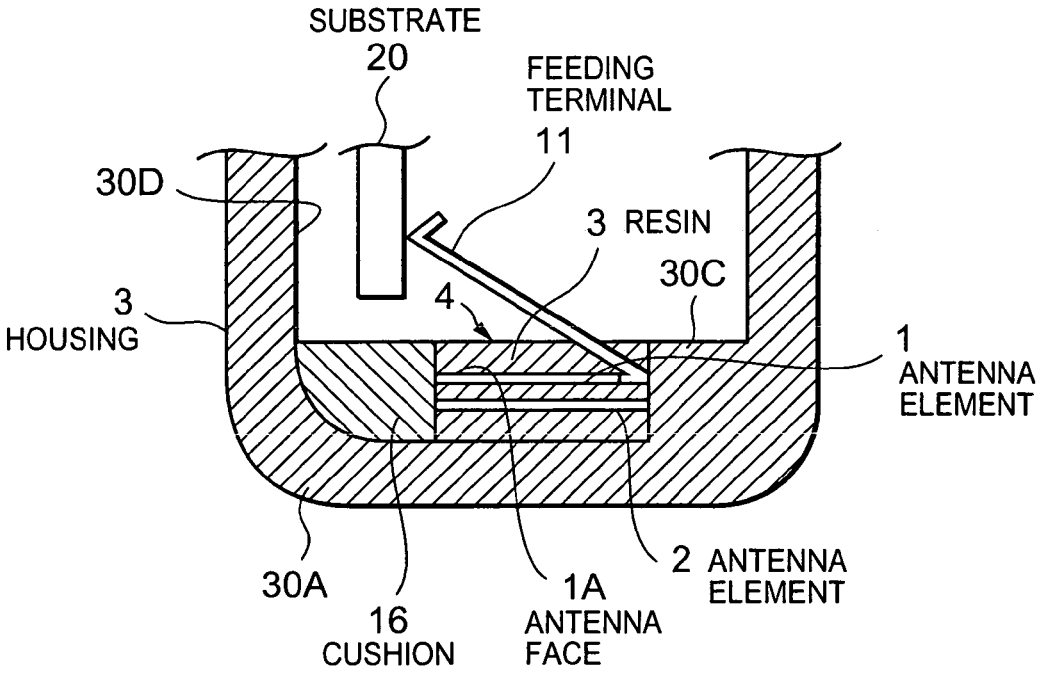
FIG. 20 shows the concept of the antenna according to the sixth embodiment arranged and stored in the wireless device.

FIG. 20 shows the sixth embodiment of the present invention. The sixth embodiment is an example of fixing the antenna unit 4 including the two antenna elements 1 and 2 fixed with the resin 3 to the end portion 30A of the housing 30 using a cushion 16. According to the sixth embodiment, a projection 30C touching one side of the antenna unit 4 is formed in the end portion 30A.

In the sixth embodiment, the other side of the antenna unit 4 touches the cushion 16, and the cushion 16 pushes the antenna unit 4 against the projection 30C for fixing. Since the antenna unit 4 is fixed to the housing 30 through the cushion 16 according to the sixth embodiment, the antenna unit 4 can be stably positioned.

The antenna unit 4 or the cushion 16 can also be attached to the housing 30 using the attachment means such as adhesives, etc. Other configurations and operation effects are the same as those of the embodiment shown in FIG. 5. Therefore the detailed explanation is omitted here.

Figure 21:
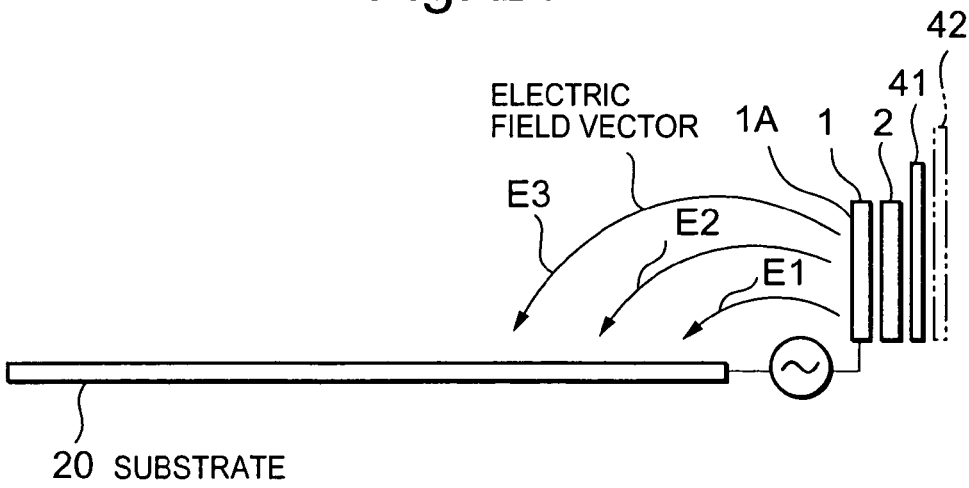
FIG. 21 shows the concept of the antenna in a variation and an application of the antenna structure shown in FIG. 1A.

According to the present invention, as shown in FIG. 21, three or four antenna elements can be provided. Practically, the antenna elements 1 and 2, an antenna element 41 indicated by solid lines, or an antenna element 42 indicated by imaginary lines can be added.

The antenna element 41 or antenna element 42 has a different shape, size, etc. to have an arbitrary resonant frequency. In this case, the feeding means as a feeding terminal is connected only to a single antenna element 1.

Figure 1C:
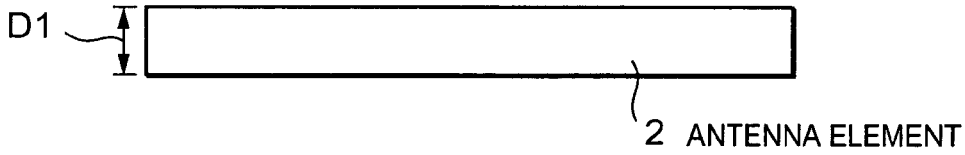
FIG. 1C shows the bottom of the antenna structure according to FIG. 1A.

According to the present invention, the above-mentioned embodiments can be arbitrarily combined, and the particular operation effects can be obtained depending on the combination. A pattern of combination can be, for example, an embodiment (shown in FIG. 9) of the antenna unit 4 in curved shape of the wall surface 30B of the housing 30, and an example (corresponding to the fourth embodiment) of arranging the plane pattern of the antenna element 1 in meandering shape, etc. In this case, the antenna element 2 opposite the wall surface 30B of the housing 30 can be arranged as a rectangular plate as shown in FIG. 1C. Combined patterns include, for example, patterns combining two or more embodiments.

Furthermore, the communication apparatus of the present invention has the concept including be an apparatus requiring an antenna, for example, a mobile telephone, a wireless device, a personal computer, a PDA (personal digital assistance), etc.

What is claimed is:

1. An antenna structure, comprising:

a plurality of antenna elements having antenna faces; and a planar substrate having a circuit pattern;

wherein said antenna elements include at least one feed element and at least one non-feed element, wherein said antenna faces are orthogonal to a plane of the substrate, wherein an antenna face of each of the antenna elements faces each other at a predetermined interval so that a current induced in the at least one feed element induces a current in the at least one non-feed element, and wherein said at least one feed element and said at least one non-feed element are arranged in a region of an end portion of the substrate along a length of the substrate, and are spaced apart at another predetermined interval from the substrate.

2. The antenna structure according to claim 1, further comprising:

a resin which fixes said plurality of antenna elements.

3. The antenna structure according to claim 1, wherein at least one of said antenna elements is bent in a two- or three-dimensional array.

4. The antenna structure according to claim 1, wherein at least one of said antenna elements and said substrate are arranged in a hollow housing, and a planar shape of the substrate is formed to correspond to a planar shape of the hollow housing and the substrate is arranged to face the internal surface of the hollow housing that is formed hollow.

5. The antenna structure according to claim 1, wherein at least one of said antenna elements and said substrate are arranged in a hollow housing, and said antenna element is configured along a planar shape of an internal surface of the hollow housing.

6. The antenna structure according to claim 4, wherein at least one of said antenna elements is arranged at an end portion along a length of the hollow housing.

7. The antenna structure according to claim 4, wherein the substrate is arranged such that the plane of the substrate as close to a wall in a thickness direction of the hollow housing, and at least one of the antenna elements is arranged close to an end portion along a length of the hollow housing.

8. The antenna structure according to claim 1, further comprising:

feeding means for feeding a voltage to the at least one feed element, wherein said feeding means is connected to a connection unit of the substrate.

9. The antenna structure according to claim 8, wherein a plurality of the antenna elements are arranged with the antenna face of the antenna element facing each other at a predetermined interval so that a current induced in the at least one feed element induces a current in the at least one non-feed element, and said feeding means is connected to the at least one feed element.

10. The antenna structure according to claim 8, wherein said feeding means is formed as an urging structure.

11. The antenna structure according to claim 8, wherein said feeding means is formed such that a part of said antenna element can be a leaf spring.

12. The antenna structure according to claim 8, wherein said feeding means is a spring connector.

13. The antenna structure according to claim 8, wherein said connection unit of the substrate is formed as an urging structure.

14. The antenna structure according to claim 1, wherein at least one of said antenna elements is set in a hollow housing through buffering means.

15. The antenna structure according to claim 1, wherein each of the plurality of antenna elements is planar.

16. The antenna structure according to claim 1, wherein the antenna face of each of the antenna elements is parallel with the antenna face of the facing antenna element, and wherein the antenna element of the feed element is parallel to the antenna element of the non-feed element.

17. The antenna structure according to claim 1, wherein said at least one non-feed element is isolated electrically from said at least one feed element.

18. The antenna structure according to claim l, wherein each plane including a surface of said at least one feed element and said at least one non-feed element crosses a substrate plane including a surface of the substrate in a region distinct from the substrate along a length of the substrate, and are spaced apart at the other predetermined interval from the end portion along the length of the substrate.

19. The antenna structure according to claim 1, wherein said at least one non-feed element is capacitively coupled with said at least one feed element.

20. The antenna structure according to claim 1, wherein a plane including a surface of said at least one feed element and a further plane including a further surface of said at least one non-feed element are parallel and offset from each other.

21. A communication apparatus, comprising:

a plurality of antenna elements having antenna faces;

and a planar substrate having a circuit pattern;

wherein said antenna elements include at least one feed element and at least one non-feed element, wherein said antenna faces are orthogonal to a plane of the substrate, wherein an antenna face of each of the antenna elements faces each other at a predetermined interval so that a current induced in the at least one feed element induces a current in the at least one non-feed element, and wherein said at least one feed element and said at least one non-feed element are arranged in a region of an end portion of the substrate along a length of the substrate, and are spaced apart at another predetermined interval from the substrate.

22. The communication apparatus according to claim 21, wherein the substrate is arranged such that the plane of the substrate as close to a wall in a thickness direction of a hollow housing, and at least one of the antenna elements and said substrate are arranged close to an end portion along a length of the hollow housing.

23. The communication apparatus according to claim 21, further comprising:

feeding means for feeding a voltage to the at least one feed element, wherein said feeding means is connected to a connection unit of the substrate.

24. The communication apparatus according to claim 21, wherein said at least one non-feed element is isolated electrically from said at least one feed element.

25. The communication apparatus according to claim 21, wherein each plane including surfaces of said at least one feed element and said at least one non-feed element crosses a substrate plane including a surface of the substrate in a region distinct from the substrate along a length of the substrate, and are spaced apart at the other predetermined interval from the end portion along the length of the substrate.

26. The communication apparatus according to claim 21, wherein said at least one non-feed element is capacitively coupled with said at least one feed element.

27. The communication apparatus according to claim 21, wherein a plane including a surface of said at least one feed element and a further plane including a further surface of said at least one non-feed element are parallel and offset from each other.

28. An antenna apparatus, comprising:

a planar substrate having a circuit pattern;

a feed element having a first antenna face, the first face being orthogonal to a plane of the substrate; and a non-feed element having a second antenna face, the second antenna face being orthogonal to the plane of the substrate and spaced apart from the first face, and the second antenna face facing the first face at a predetermined interval so that a current induced in the feed element induces a current in the non-feed element, wherein said feed element and said non-feed element are arranged in a region of an end portion of the substrate along a length of the substrate, and are spaced apart at another predetermined interval from the substrate.

29. The antenna apparatus according to claim 28, wherein said at least one non-feed element is isolated electrically from said at least one feed element.

30. The antenna apparatus according to claim 28, wherein each plane including surfaces of said at least one feed element and said at least one non-feed element crosses a substrate plane including a surface of the substrate in a region distinct from the substrate along a length of the substrate, and are spaced apart at the other predetermined interval from the end portion along the length of the substrate.

31. The antenna apparatus according to claim 28, wherein said at least one non-feed element is capacitively coupled with said at least one feed element.

32. The antenna apparatus according to claim 28, wherein a plane including a surface of said at least one feed element and a further plane including a further surface of said at least one non-feed element are parallel and offset from each other.

33. An antenna structure, comprising:

a plurality of antenna elements having antenna faces; and a planar substrate having a circuit pattern;

wherein said antenna elements include at least one feed element and at least one non-feed element, wherein said antenna faces are orthogonal to a plane of the substrate, wherein an antenna face of each of the antenna elements faces each other at a predetermined interval so that a current induced in the at least one feed element induces a current in the at least one non-feed element, and wherein said at least one feed element and said at least one non-feed element are arranged in an outside region of the substrate along a length of the substrate, and are spaced apart at another predetermined interval from the end portion along the length of the substrate.

34. The antenna structure according to claim 33, wherein said at least one non-feed element is isolated electrically from said at least one feed element.

35. The antenna structure according to claim 33, wherein each plane including surfaces of said at least one feed element and said at least one non-feed element crosses a substrate plane including a surface of the substrate in a region distinct from the substrate along a length of the substrate, and are spaced apart at the other predetermined interval from the end portion along the length of the substrate.

36. The antenna structure according to claim 33, wherein said at least one non-feed element is capacitively coupled with said at least one feed element.

37. The antenna structure according to claim 33, wherein a plane including a surface of said at least one feed element and a further plane including a further surface of said at least one non-feed element are parallel and offset from each other.

* * * * *